US005109775A

United States Patent [19]

Kershaw et al.

[11] Patent Number: 5,109,775

[45] Date of Patent: May 5, 1992

[54] BALLAST RECONDITIONING APPARATUS WITH MULTIPLE EXCAVATING WHEELS AND INDEPENDENT CLEANING STATIONS FOR INCREASED OPERATING SPEED

[75] Inventors: John K. Kershaw; Philip C. McCray, both of Montgomery, Ala.

[73] Assignee: Knox Kershaw, Inc., Montgomery, Ala.

[21] Appl. No.: 590,030

[22] Filed: Sep. 28, 1990

[51] Int. Cl.[5] ..... E01B 27/06

[52] U.S. Cl. ..... 104/2; 37/104; 171/16

[58] Field of Search ..... 104/2, 5, 12; 37/104, 37/105, 106, 107; 171/16

[56] References Cited

U.S. PATENT DOCUMENTS

| | | | |
|---|---|---|---|
| 865,261 | 9/1907 | Mehaffey | 37/104 X |
| 2,022,150 | 11/1935 | Protzeller | 37/104 |
| 2,842,069 | 7/1958 | McWilliams | 104/5 |
| 2,997,001 | 8/1961 | Scheuchzer | 104/2 |
| 3,872,929 | 3/1975 | Theurer et al. | 104/2 X |
| 4,674,208 | 6/1987 | Whitaker, Jr. | 171/16 X |
| 4,705,115 | 11/1987 | Whitaker, Jr. | 104/2 X |
| 4,890,557 | 1/1990 | Whitaker, Jr. | 104/2 X |

*Primary Examiner*—Robert J. Oberleitner
*Assistant Examiner*—S. Joseph Morano
*Attorney, Agent, or Firm*—Phillips & Beumer

[57] ABSTRACT

Apparatus for excavating ballast from a railroad bed adjacent to the cross ties of a railroad track and for cleaning the excavated ballast for return thereof to the railroad bed. The apparatus includes a vehicle for supporting a pair of excavating assemblies on opposite sides of the support vehicle and thus on opposite sides of the railroad track and a discrete cleaning station for each of the separate excavating assemblies. Each cleaning station is disposed for receiving and cleaning the ballast excavated by the associated excavating assembly.

14 Claims, 2 Drawing Sheets

BALLAST RECONDITIONING APPARATUS WITH MULTIPLE EXCAVATING WHEELS AND INDEPENDENT CLEANING STATIONS FOR INCREASED OPERATING SPEED

FIELD OF THE INVENTION

The present invention relates generally to the field of railroad maintenance and particularly to apparatus for reconditioning the ballast at a relatively high rate of speed by providing a discrete reconditioning apparatus for each ballast pick-up wheel.

BACKGROUND OF THE INVENTION

Railroad ballast cleaning machinery is well known in the art. These machines take up the ballast from the track bed, clean the ballast, return the cleaned material to the track, and discard the "dirt" or waste contaminating material. One reason for cleaning the ballast is to provide cleaner ballast which can drain water away from the railroad cross ties in order to ensure a longer "life" for the ties. Over a period of time, the track bed becomes contaminated by mud working its way up from underneath, by dirt getting into the ballast from the top, or by the ballast being slowly ground into small particles by vibration caused as trains pass over the ballast. The ballast becomes so contaminated after a period of time that moisture is held around the ties, thus resulting in deterioration of the ties, which results in expensive tie replacement becoming necessary. Thus, periodic ballast cleaning is necessary to ensure good drainage. A further disadvantage of contaminated ballast is that the track tends to settle in muddy spots, thus destroying the alignment (line) and surface of the rails.

Some types of ballast cleaners are disclosed in U.S. Pat. Nos. 4,705,115, issued on Nov. 10, 1985, to John B. Whitaker, Jr.; 4,850,123, issued on Jul. 25, 1989, to John B. Whitaker, Jr.; 4,534,415, issued on Aug. 13, 1985, to Josef Theurer; and 4,813,488, issued on Mar. 31, 1989, to Josef Theurer. Typically, there are two types of ballast cleaners. One type simply takes up the ballast along the track shoulders (outside the ends of the cross ties) and is known as a "shoulder cleaner." The second type takes up the material underneath and between the cross ties and is known as an "undercutter cleaner."

Normally, a shoulder cleaner utilizes a rotating "ditcher wheel" on each side to take the ballast up from the track shoulder while an undercutter uses a continuous cutter chain to pull the material from underneath the track.

One type of chain design (U.S. Pat. No. 4,813,488, issued to Josef Theurer and assigned to Franz Plasser, Vienna, Austria) is such that it picks up the material on the shoulder along with the under-track material. After the material is picked up, it is carried to a single cleaning station comprised of a pair of vibrating cleaning screens. The vibrating screens shake the contaminants from the ballast and separates the larger pieces of ballast from the unwanted smaller pieces of contaminants. A common outlet is provided to return the cleaned ballast to the track bed. The waste material is conveyed from the screen to the side of the track or it is loaded onto a hopper car. The speed of the operation of this apparatus is limited by the provision of a single outlet common to the two cleaning screens which control the rate of flow of the cleaned ballast back to the track.

Furthermore, the apparatus of U.S. Pat. No. 4,813,488 requires the use of an undercutter chain under the tracks and that the tracks be raised so that the chain can be installed in a passageway which must be dug out from under the tracks. After the ballast cleaning operation is completed, the tracks must be levelled in an attempt to restore the original track line.

U.S. Pat. No. 4,534,415, issued to Josef Theurer and assigned to Franz Plasser, Vienna, Austria, is directed to a ballast cleaning machine with two ballast screening installations. While this patent discloses the provision of two screens for cleaning the ballast, it should be noted that this apparatus also uses a single excavating mechanism (undercutter chain) which limits the forward speed of the apparatus for reasons explained supra, in conjunction with U.S. Pat. No. 4,813,488. Additionally, the speed of operation is limited to the speed of operation and the size of the conveyor belts which are used to redistribute the cleaned ballast back to the track bed.

In U.S. Pat. Nos. 4,705,115 and 4,850,123, a single vibrating screen (cleaning station) is used in conjunction with a single ditcher wheel or, in the case of U.S. Pat. No. 4,705,115, an apparatus which has two ditcher wheels, one wheel on each side of the frame. However, since only one screen is used in conjunction with the ditcher wheel (or wheels), the speed of the apparatus is limited to the speed at which the ballast can be cleaned at the single cleaning station. An additional drawback of U.S. Pat. No. 4,705,115 is that only the portion of the ballast under the tracks is cleaned in a single operation, while the excavated shoulder ballast is returned uncleaned to the center of the track. Such procedure requires more frequent periodic cleaning operations.

Apparatus of the present invention overcomes the above-noted drawbacks and inadequacies by providing a ballast reconditioning system having a pair of excavating ditcher wheels with each ditcher wheel being placed on opposite sides of a supporting frame. Each ditcher wheel includes a plurality of annularly arranged buckets which pick up the ballast and empties the ballast that is picked up by the buckets onto a discrete corresponding cleaning station, thus resulting in a ballast cleaning system which cleans the ballast at generally twice the speed that any of the prior art patents can accomplish. An excavating member is also mounted to the vehicle frame behind each ditcher wheel to remove ballast from beneath the cross ties.

SUMMARY OF THE INVENTION

It is an object of the present invention to provide a system for removing ballast from along the shoulder of a railroad track and from under the cross ties supporting the track.

It is another object of the present invention to provide such a system which will accomplish the ballast cleaning operation in a rapid and facile manner so as to minimize the "down" time of the railroad track.

It is a further object of the present invention to provide such a ballast cleaning system with a dual set of ditcher wheels simultaneously operable on opposite sides of the railroad bed.

It is yet another object of the present invention to provide a pair of cleaning stations, each station being associated with only one of the ditcher wheels to receive ballast picked up by only the associated ditcher wheel.

DESCRIPTION OF THE PREFERRED EMBODIMENT

Figure 1:
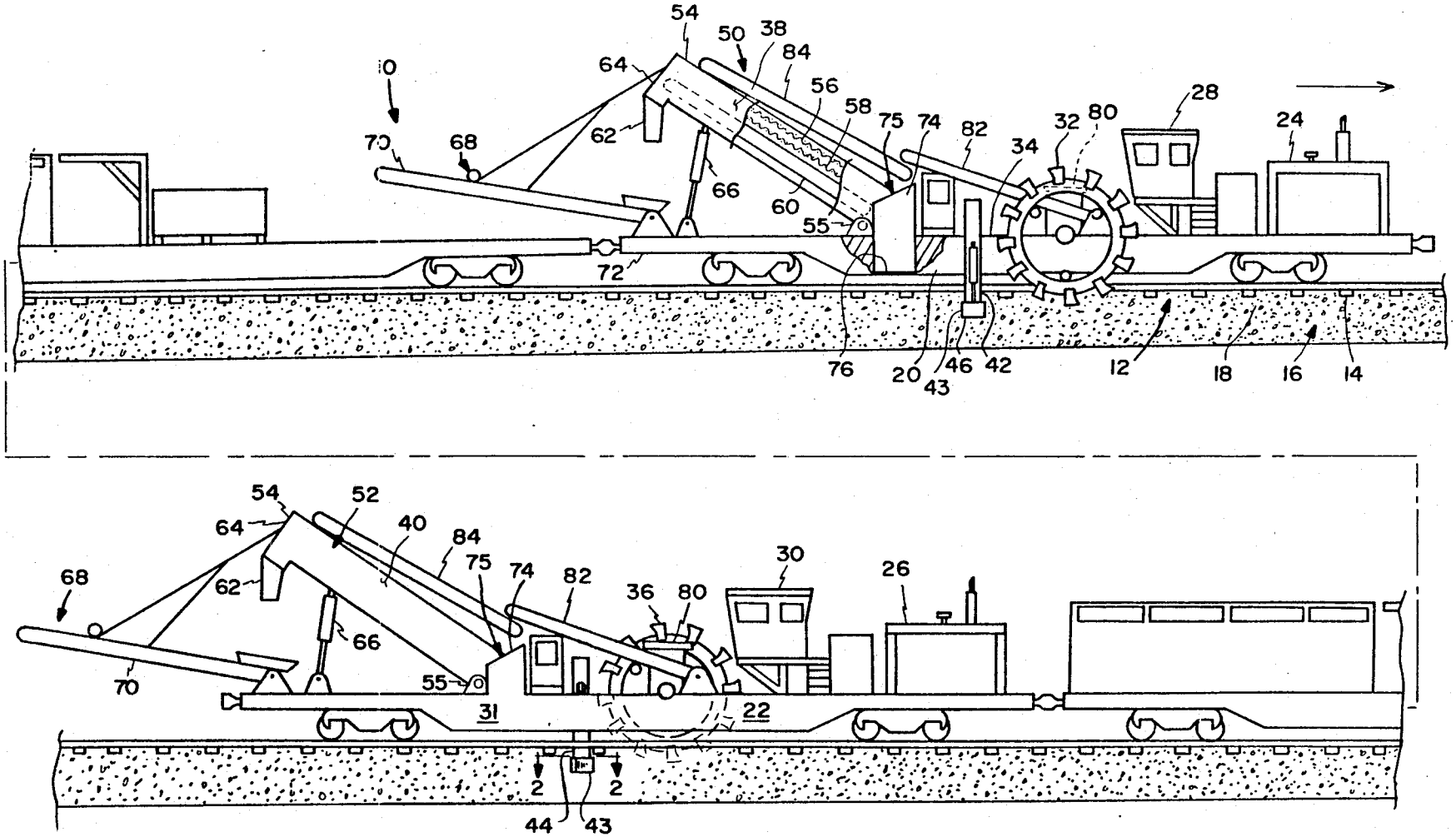
FIG. 1 is an elevational view of the ballast cleaning system of the present invention.

As seen in FIG. 1, a ballast reconditioner system 10 is shown supported on a track 12 having cross ties 14 which are supported on a bed 16 comprised of ballast 18. The reconditioner system is shown to include a pair of vehicle frames 20 and 22 having power units 24 and 26, respectively, which propel the system and provide the motive power for driving various components of the system. An operator occupies cabs 28 and 30 carried on vehicle frames 20 and 22, respectively. The cabs are equipped with conventional control mechanisms which are conventionally connected to the various components for operation thereof. A ditcher wheel 32 is disposed rearwardly of cabs 28 on a first side 34 of frame 20, and a second ditcher wheel 36 is disposed rearwardly of cab 30 on a second side 31 of frame 22. Wheels 32 and 36 are on opposite sides of vehicle frames 20 and 22 and thus are on opposite sides of railroad track 12. Each ditcher wheel, as is known in the art, is hydraulically controlled to be raised and lowered as well as being movable inward and outward. Cleaning stations 38 and 40 are respectively disposed rearwardly of the ditcher wheels 32 and 36 so that each ditcher wheel has its own associated cleaning station.

A pair of excavating members 42 and 44 are disposed rearwardly of ditcher wheels 32 and 36, respectively. Excavating member 42 is mounted on the same side of frame 20 as is the ditcher wheel 32 and excavating member 44 is mounted on the same side of frame 22 as is ditcher wheel 36. Excavating members 42 and 44 are each provided with a lower base portion 45 having a projecting portion (tooth) 46 which is arranged to project under the ends of the cross ties to remove ballast which is underneath and adjacent to the ends of the cross ties. The excavating members may be rotatable or stationary. However, it is necessary that the excavating members be capable of being raised and lowered so that they may be movable into operating position when in their lowered position and out of operation (such as when travelling to a work site) when in their raised position. It is also desirable that the projecting tooth portion of the excavating member be capable of inward movement a predetermined distance under the cross ties and outward movement to be clear of the ends of the cross ties.

Figure 2:
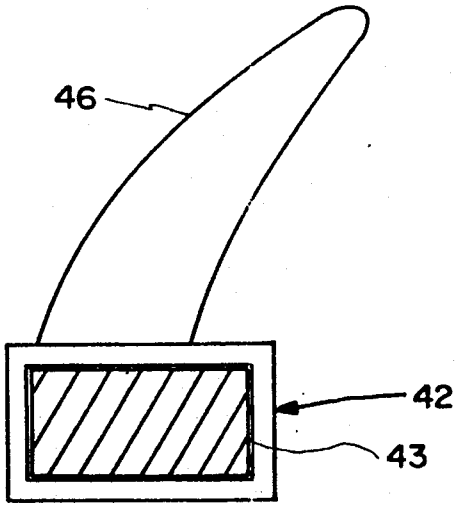
FIG. 2 is a sectional view taken along line 2—2 of FIG. 1.

Excavating members 42 and 44, shown in FIG. 2, are nonrotatable and define a scarifier tooth. Such stationary excavating members include a base portion 43 from which the inwardly projecting (tooth) portion 46 extends. Each projecting tooth portion includes a forward ballast contacting surface which is disposed in angular relation to the base portion. The angular relation permits the projecting (tooth) portions to remove the ballast from under the track and deposit the ballast adjacent to the track as the apparatus moves along the track. Mechanisms for controlling movement (raising, lowering, tilting, etc.) of the excavating members is well known in the art. U.S. Pat. No. 4,850,123 discloses a rotary excavating member which may be movably mounted. A second pass of the area is generally required in order for the ditcher wheels to pick up the ballast removed by the scarifier excavating members.

Hydraulic cylinders and associated hydraulic mechanisms such as pumps, lines, valves., etc. (not shown), may be provided and operable by the operator in the cab for actuating and controlling the various components of the system. Such hydraulic mechanisms are well known in the art.

It is to be understood that the cleaning stations 38 and 40 are well known in the art. Typically, the cleaning stations include a pair of vibrating screen assemblies generally indicated by the numerals 50 and 52 in FIG. 1. Each assembly includes a pivotally mounted enclosed box-like structure 54 which encloses a pair of screens 56 and 58 and a conveyor belt 60 which is mounted beneath the screens. A vibrating mechanism (not shown), well known in the art, is disposed for vibrating the enclosure. A discharge port 62 is disposed at the rear 64 of enclosure 54 for reasons explained hereinbelow. A hydraulic piston and cylinder assembly 66 is controlled by the operator in the cab to pivot the enclosure 54 around pivot support 55 to raise and lower the enclosure and attendant structure.

Enclosure 54, and thus the screens carried therein, have been designed to operate between 10 degrees and 35 degrees to provide a 25-degree operating range not found in the art. The flatter screen angle (lower elevation) is useful in extremely wet, muddy conditions, since the lower elevation permits the ballast to stay on the vibrating screen for a longer period of time, thus enabling the extremely dirty ballast to be vibrated for a longer period of time to better clean the ballast. The production rate is necessarily decreased during this time, but such procedure enables the apparatus to work on wet days (when otherwise work would be impossible). The steep angle (35 degrees) allows maximum production when conditions are dry enough for good cleaning efficiency with a minimum of time on the screen.

A waste conveyor assembly 68 is provided and includes a conveyor 70 which is movable to either the rear of the vehicle frames or to the sides of the vehicle frame. Conveyor 70 is mounted at the rear 72 of the vehicle frames beneath discharge port 62 of the vibrating enclosure 54 to receive and discharge the contaminants and debris from port 62.

To return the "cleaned" ballast to the track bed, a hopper 74 is provided at the forward end 75 to receive the cleaned ballast from the cleaning station and to direct the ballast to the track bed through an opening 77 in the bottom of the hopper. A pair of hydraulically-operated closure members 76 are mounted in an opening 77 disposed in the bottom of each hopper to control the flow of the ballast back to the track bed. Each of the hydraulically-operated doors is independently actuated so that the flow of ballast may, for example, be permitted to flow through the right side of the hopper to be directed to the right side of the track to replace ballast removed by the right ditcher wheel, and vice versa. Or, if desired, both closure members may be opened to permit ballast flow on both sides of the track center line.

In operation, both vehicle frames are simultaneously moved along the track while each ditcher wheel continuously picks up the ballast adjacent to the opposite tie rod ends. The ballast from the ditcher wheels is deposited on transverse conveyor assemblies 80, which in turn deposits the excavated ballast onto a first main conveyor assembly 82. Conveyor assembly 82 is angled upwardly to carry the ballast to a second conveyor assembly 84 which continually deposits the ballast in the rear 64 of raised enclosure 50. Enclosure 54 is vibrated, by means well known in the art, to shake the contaminants (dust, mud, small particles, etc.) from the ballast, which falls through the openings in screens 56 and 58 to conveyor 60. The smaller contaminants are carried by conveyor 60 to discharge chute 62 and are discharged onto conveyor assembly 68 which empties the contaminants to sides of the vehicle frames away from the railroad bed. If desired, the discharge chute may be moved to the rear of the vehicle frame to empty the contaminants into a "waste" car carried behind the vehicle frame.

The cleaned ballast is caused to move down the screens by the vibratory movement of the tilted enclosure and is emptied into its respective hopper 74 and directed through the opening 77 in the bottom of the hopper to the track bed in the manner previously described. If desired, scraper and sweeper assemblies (not shown) may be positioned beneath the vehicle frame behind the hopper to smoothly distribute the cleaned ballast as it is deposited along the track bed.

It is to be understood that while the apparatus of our invention is described as having a pair of vehicle frames each having a reconditioning apparatus including a ditcher wheel, an undercutter, and conveying mechanism mounted thereon, this is not to be taken in a limiting sense since the apparatus may be designed to be carried by a single vehicle frame, if desired.

It is to be understood that while we have described our invention in connection with a specific embodiment thereof, this has been done by way of example only and not as a limitation to the spirit and scope of our invention as set forth in the objects and in the appended claims.

We claim:

1. Apparatus for excavating ballast from a railroad bed having cross ties for support of a railroad track thereon and for cleaning the excavated ballast, said apparatus comprising:

vehicular support means disposed for movement along the rails of said railroad track, said vehicular support means having a frame means provided with first and second sides;

a first excavating wheel assembly including a plurality of annularly arranged bucket members supported on said first side of said frame means for excavating ballast adjacent to a first end of said cross ties;

a second excavating wheel assembly including a second plurality of annularly arranged bucket members supported on said second side of said frame means for excavating ballast adjacent to a second end of said cross ties; and a pair of discrete cleaning stations, each cleaning station carried on said frame means between said first and second sides and in spaced relation with said first and second excavating wheel assemblies and associated with a respective one of said excavating wheel assemblies for independently cleaning said ballast excavated by said associated excavating wheel assemblies, said pair of discrete cleaning stations comprising a vibratory enclosure having reticular elements mounted therein and disposed for vibratory movement to vibrate contaminants from said ballast, said vibratory container having a receiving end portion for receiving said ballast from said associated excavating wheel assembly and a discharge end portion for discharging said ballast from said vibratory enclosure, said receiving end portion of said enclosure being positionable at a predetermined elevation relative to said discharge end portion of said enclosure whereby the rate of discharge of said ballast from said enclosure is controllable.

2. Apparatus as set forth in claim 1 including ballast discharge means carried on said frame means to receive cleaned ballast from each said cleaning station and for directing said clean ballast back to said railroad bed.

3. Apparatus as set forth in claim 2 wherein said discharge means includes hopper means carried on said frame means between said first and second sides thereof for receiving said cleaned ballast from said cleaning station and redepositing said cleaned ballast to said railroad bed.

4. Apparatus as set forth in claim 3 including conveyor means for conveying said ballast from said first and second excavating wheel assemblies to their respective cleaning station for reconditioning said ballast prior to the discharge thereof by said discharging means.

5. Apparatus as set forth in claim 1 including contaminant discharge means associated with each said cleaning station to discharge the waste contaminants removed at each said cleaning station from said excavated ballast.

6. Apparatus as set forth in claim 1 including actuating means for elevating said enclosure to said predetermined operating elevation.

7. Apparatus as set forth in claim 6 wherein said predetermined operating elevation is in the range of 10 degrees to 35 degrees.

8. Apparatus as set forth in claim 7 including undercutting means supported on said frame means rearwardly of each of said excavating wheels for removing said ballast from beneath said track adjacent to the ends of said cross ties.

9. Apparatus as set forth in claim 8 wherein said undercutting means comprises a non-rotatable, substantially vertical support means having a base portion provided with a projecting member disposed for reaching inwardly of the ends of said cross ties.

10. Apparatus as set forth in claim 9 wherein said frame means is a pair of vehicle frames disposed in tandem relation, the first of said vehicle frames having the first of said pair of cleaning stations mounted thereon in communication with said first excavating wheel to receive the excavated ballast therefrom, and the second of said vehicle frames having the second of said pair of cleaning stations mounted thereon in communication with said second excavating wheel to receive the excavated ballast therefrom.

11. Apparatus as set forth in claim 1 including undercutting means supported on said vehicular support means rearwardly of each said excavating means for removing ballast from beneath said track and said cross ties.

12. Apparatus as set forth in claim 1 wherein said frame means is a pair of vehicle frames disposed in tandem relation, the first of said vehicle frames having the first of said pair of cleaning stations mounted thereon in communication with said first excavating means to receive the excavated ballast therefrom, and the second of said vehicle frames having the second of said pair of cleaning stations mounted thereon in communication with said second excavating means to receive the excavated ballast therefrom.

13. Apparatus for excavating ballast from a railroad bed having cross ties for support of a railroad track thereon and for cleaning the excavated ballast, said apparatus comprising:

vehicular support means disposed for movement along the rails of said railroad track, said vehicular support means including a frame provided with first and second sides;

a first excavating wheel assembly including a plurality of annularly arranged bucket members supported for driven rotation on said first side of said frame for excavating said ballast adjacent to a first end of said cross ties;

a second excavating wheel assembly including a second plurality of annularly arranged buckets supported for driven rotation on said second side of said frame by excavating said ballast adjacent to a second end of said cross ties;

first and second discrete cleaning stations, each said cleaning station including a vibratory container having screen members therein for separating contaminants and debris from the excavated said ballast, said first discrete cleaning station stationarily secured to said frame of said vehicular support means in spaced, unsupported relation with said first excavating wheel assembly, said second discrete cleaning station secured to said frame of said vehicular support means in spaced, unsupported relation with said second excavating wheel assembly;

first conveying means including a first transverse conveyor assembly and a first longitudinal conveyor assembly mounted on said frame and communicating with said first cleaning station to carry the excavated said ballast to said first cleaning station;

second conveying means including a second transverse conveyor assembly and a second longitudinal conveyor assembly mounted on said frame and communicating with said second cleaning station to carry the excavated said ballast to said second cleaning station; and ballast discharge means including:

a first hopper mounted on said frame adjacent to said first vibratory container to receive the cleaned said ballast from said first vibratory container for depositing the cleaned said ballast back to said railroad bed, and a second hopper mounted on said frame adjacent to said second vibratory container to receive the cleaned said ballast from said second vibratory container for depositing the cleaned said ballast back to said railroad bed.

14. Apparatus as set forth in claim 13 wherein said first and second hopper include a bottom section and closure means mounted in said bottom section, said closure means operable to open or close predetermined portions of said bottom section and thus control the amount and direction of flow of the cleaned said ballast back onto said railroad bed.

* * * * *